US007065807B1

(12) United States Patent
Stout, Jr.

(10) Patent No.: US 7,065,807 B1
(45) Date of Patent: Jun. 27, 2006

(54) ADJUSTABLE SHOWER HEAD

(76) Inventor: Leonard L. Stout, Jr., 3351 Fresno St., Denair, CA (US) 95316

( * ) Notice: Subject to any disclaimer, the term of this patent is extended or adjusted under 35 U.S.C. 154(b) by 0 days.

(21) Appl. No.: 11/175,479

(22) Filed: Jul. 7, 2005

(51) Int. Cl.
*A47K 3/22* (2006.01)
*A47K 3/34* (2006.01)
*A47K 3/36* (2006.01)

(52) U.S. Cl. ..... 4/615; 4/567

(58) Field of Classification Search ..... 4/615, 4/618, 567, 568, 570; 239/195; 137/801
See application file for complete search history.

(56) References Cited

U.S. PATENT DOCUMENTS 2,997,722 A 8/1961 Pearson
3,737,107 A 6/1973 Wright
3,884,258 A 5/1975 Mull
4,926,511 A 5/1990 Coll
5,027,450 A 7/1991 Lang
6,378,912 B1 * 4/2002 Condon et al. ..... 4/615
6,381,770 B1 5/2002 Raisch

* cited by examiner

*Primary Examiner*—Tuan Nguyen

(57) ABSTRACT

An assembly includes a conduit that has one end portion engaged with a water supply source and another end portion situated to an exterior of a shower wall. A shower head that has a tapered end portion is conjoined to another end portion. A wall flange, fastened to an exterior of the shower wall, has a funnel portion protruding orthogonally away therefrom. A support beam, positioned orthogonal to a longitudinal axis and attached to the rear of the shower wall, has a pair of sides disposed orthogonal to each other. A support bracket, fastened to one side, has an aperture formed therein for guiding the conduit therethrough. The wall flange has an aperture registered with the support bracket aperture for guiding the conduit therealong. A sleeve, fastened to the support bracket and the support beam, has first and second end portions directing the conduit vertically and horizontally therealong.

18 Claims, 6 Drawing Sheets

ADJUSTABLE SHOWER HEAD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to shower heads and, more particularly, to an adjustable shower head for assisting a user to more effectively extend and retract the shower head from a rested position.

2. Prior Art

The use of adjustable shower heads is known in the prior art. More specifically, adjustable shower heads heretofore devised and utilized are known to consist basically of familiar, expected and obvious structural configurations, notwithstanding the myriad of designs encompassed by the crowded prior art which have been developed for the fulfillment of countless objectives and requirements.

Adjustable shower head assemblies are conventionally constituted by a hose which may be in the form of a flexible tube protected by metal coils or in the form of a plastic hose optionally including braiding. In either case, the hose is generally linear in shape and has a length lying in the range 1.25 meters (m) to 2 m. When not in use, the hose hangs down into a bath tub or other bathroom fitting where it is often dirtied by contact with dirty water.

Sometimes the hose can be hidden away in a chute (requiring a hole to be made), in which case it dirties a volume that is inaccessible for cleaning. The hole often leads to water seeping under the bath tub. Furthermore, these drawbacks (difficulty of storage and problems with dirt) make it undesirable to install a longer hose, even though a longer hose would often be convenient when the shower head is in use. As a result of shower hoses not being long enough, they are often damaged by the user pulling on them.

Accordingly, a need remains for an adjustable shower head in order to overcome the above-noted shortcomings. The present invention satisfies such a need by providing an adjustable shower head that is convenient and easy to use, provides adequate reach and adjusting capabilities for various applications, and is attractive in appearance. Such an adjustable shower head assembly provides the user with a shower head that can conveniently remain positioned against a wall for normal showering operations, or can be extended for other applications like washing one's hair or cleaning the shower. The adjustable shower head assembly is appreciated by all, but especially by the elderly and physically disabled who have difficulty using conventional fixed shower heads.

BRIEF SUMMARY OF THE INVENTION

In view of the foregoing background, it is therefore an object of the present invention to provide an adjustable shower head. These and other objects, features, and advantages of the invention are provided by a retractable shower head assembly for assisting a user to more effectively extend and retract the shower head from a rested position.

The shower head assembly includes an elongated and flexible conduit that has a first end portion operably engageable with a water supply source and is in direct fluid communication therewith for effectively channeling water along an upward and unidirectional path through the conduit. Such a conduit further has a second end portion situated to an exterior of a vertical shower wall wherein the second end portion can conveniently be selectively adapted between extended and retracted positions defined distally from the shower wall. A shower head that has a tapered end portion is directly conjoined to the second end portion of the conduit.

The shower head assembly preferably further includes a weight member directly conjoinable to a portion of the conduit which remains hidden behind the shower wall. Such a weight member effectively creates a downward force for counteracting a user's lateral force when extracting the shower head from the rested position and thereby conveniently causes the shower head and the conduit to retract back to the rested position when the user decreases the lateral force beyond a minimal threshold. The weight member may be slidably positional along a length of the conduit and securely engageable at alternate positions as desired by the user.

A wall flange is directly fastened to an exterior surface of the shower wall. Such a wall flange has a monolithically formed funnel portion protruding orthogonally and distally from the shower wall wherein the tapered end portion of the shower head is guided through the funnel portion for advantageously assisting an operator to more effectively maintain the shower head at a stable position when adapted to the retracted position.

An elongated and rigid support beam has a centrally disposed longitudinal axis positioned orthogonal to a longitudinal axis of the shower wall in such a manner that the support beam traverses a travel path of the conduit. Such a support beam is directly attached to a rear surface of the shower wall and has a pair of monolithically formed sides disposed orthogonal to each other.

A support bracket is securely and directly fastened to one of the support beam sides such that the support bracket is effectively maintained at a static position and further maintains continuous surface area contact with the support beam sides as well as a selected portion of the shower wall rear surface. Such a support bracket has an aperture formed therein for receiving and guiding the conduit through the shower wall. The wall flange has an aperture horizontally registered with the support bracket aperture for effectively guiding the conduit along a horizontal path exiting the shower wall.

The support bracket preferably further includes monolithically formed first, second, and third walls. Such first and third walls are registered parallel to each other. The second wall is medially situated between the first and third walls and extends orthogonal thereto respectively. The first, second, and third walls are sized and shaped for conforming to the support beam sides such that the support bracket can advantageously be effectively leveraged and supported by the support beam during operating conditions. Such a third wall of the support bracket and the wall flange may be aligned on opposite faces of the shower wall in such a manner that the shower wall becomes intercalated therebetween. The second wall of the support bracket preferably has a latitudinal length equal to a latitudinal length of one of the support beam sides such that the third wall of the support bracket can effectively be directly engaged and remain flush with the shower wall.

A non-linear sleeve is directly fastened to the support bracket and the support beam wherein the sleeve extends rearwardly from the shower wall. Such a sleeve has monolithically formed first and second end portions for directing the conduit along vertical and horizontal paths during operating conditions and thereby allowing a user to minimize frictional contact with the support bracket and the support beam when extracting the shower head away from the shower wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
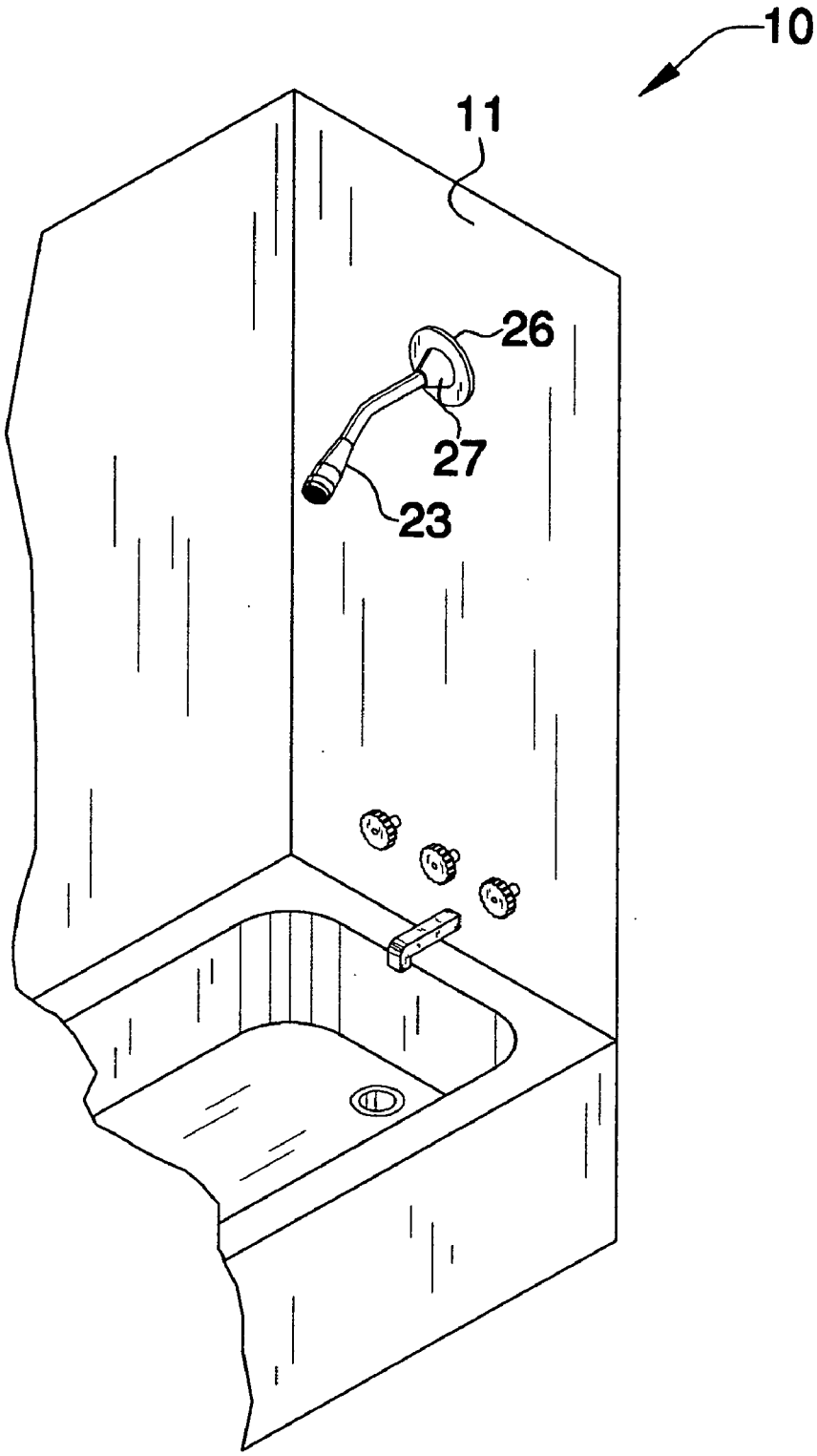
FIG. 1 is a perspective view showing an adjustable shower head assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–6 by the reference numeral 10 and is intended to provide an adjustable shower head. It should be understood that the assembly 10 may be used to extend many different types of shower heads and should not be limited in use to only extending conventional shower heads.

Figure 2A:
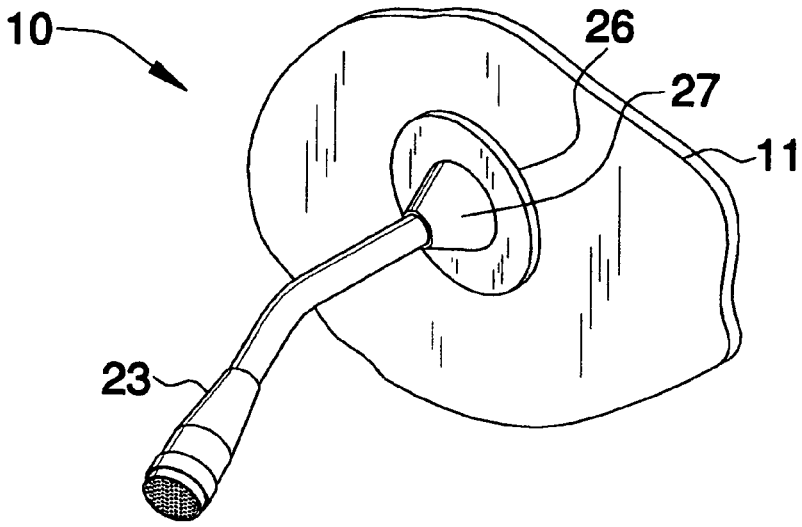
FIG. 2*a* is an enlarged perspective view of the assembly shown in FIG. 1.
Figure 2B:
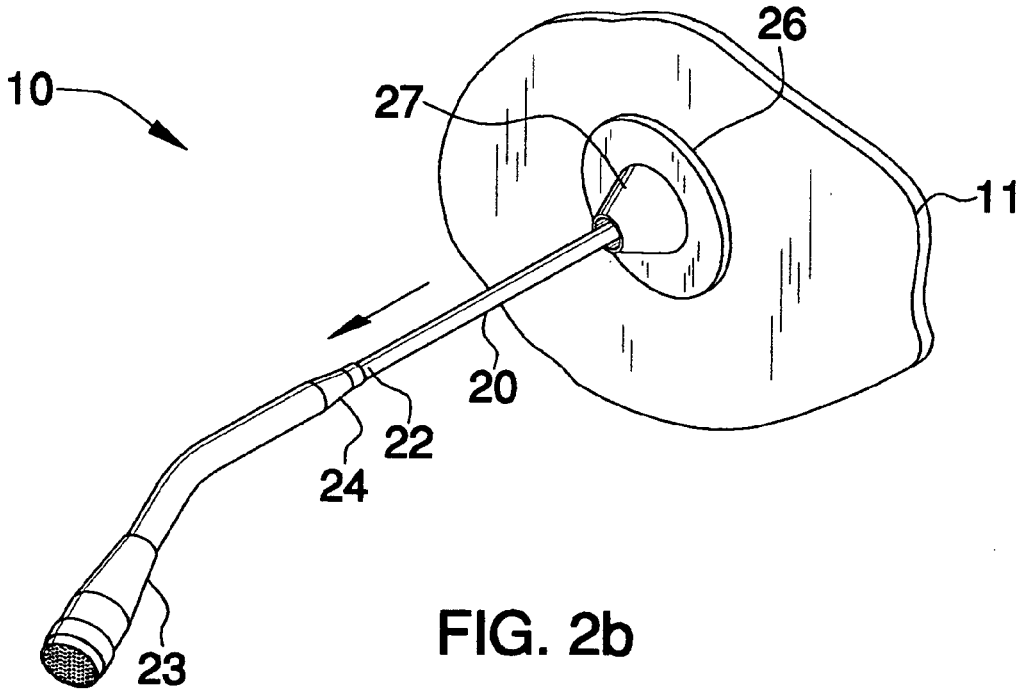
FIG. 2*b* is an enlarged perspective view of the assembly shown in FIG. 1, showing the assembly extended from the vertical shower wall.
Figure 3:
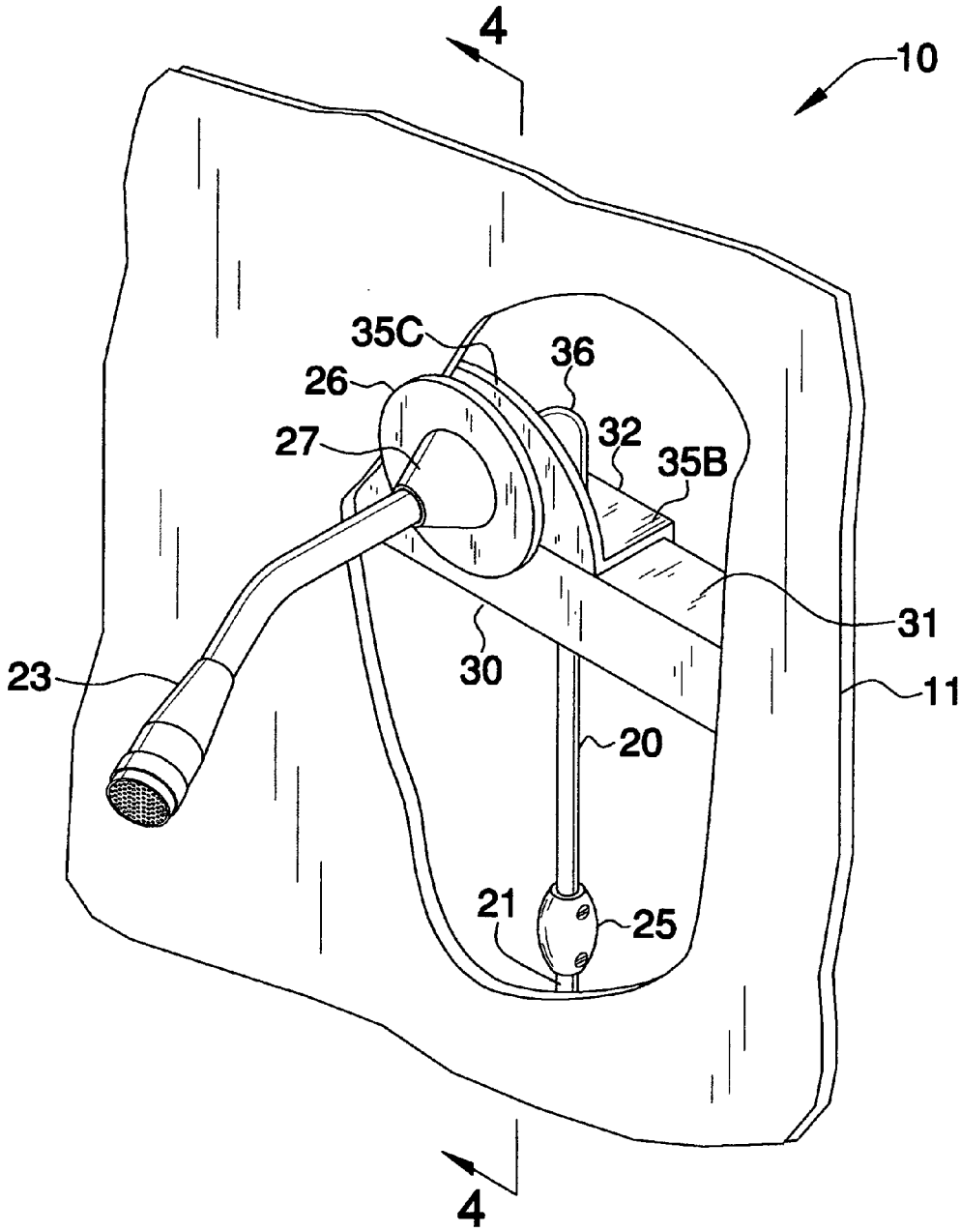
FIG. 3 is an enlarged cut-away perspective view of the assembly shown in FIG. 1, showing the flexible conduit, support bracket, weighted member, and non-linear sleeve located behind the vertical shower wall.

Referring initially to FIGS. 2*b* and 3, the assembly 10 includes an elongated and flexible conduit 20 that has a first end portion 21 operably engageable with a water supply source and is in direct fluid communication therewith, which is essential for effectively channeling water along an upward and unidirectional path through the conduit 20. Such a conduit 20 further has a second end portion 22 situated to an exterior of a vertical shower wall 11 wherein the second end portion 22 can conveniently be selectively adapted between extended and retracted positions defined distally from the shower wall 11. This feature advantageously allows a user to more easily reach and subsequently rinse hard to reach areas of their bodies, especially their lower extremities. The extending feature of the conduit 20 also conveniently allows the assembly 10 to be used for cleaning the shower walls 11.

A shower head 23 that has a tapered end portion 24 is directly conjoined, with no intervening elements, to the second end portion 22 of the conduit 20. Of course, any type of shower head 23 may be attached to the second conduit end portion 22 so as to meet the physical and aesthetic needs of the user and their bathroom, respectively, as is obvious to a person of ordinary skill in the art.

Referring to FIGS. 3 through 6, the shower head assembly 10 further includes a weight member 25 directly conjoinable, with no intervening elements, to a portion of the conduit 20 which remains hidden behind the shower wall 11. Such a weight member 25 is vital for effectively creating a downward force to counteract a user's lateral force when extracting the shower head 23 from the rested position. Such a weight member 25 conveniently causes the shower head 23 and the conduit 20 to retract back to the rested position when the user decreases the lateral force beyond a minimal threshold. This feature advantageously eliminates the need for a bulky and difficult to install retracting mechanism (not shown) as is known in other such applications, thus making the assembly 10 easier and less expensive to install. The weight member 25 is slidably positional along a length of the conduit 20 and securely engageable at alternate positions as desired by the user, thus allowing the conduit 20 to be extended beyond a length thereof defined by the initial position of weight member 25.

Figure 4:
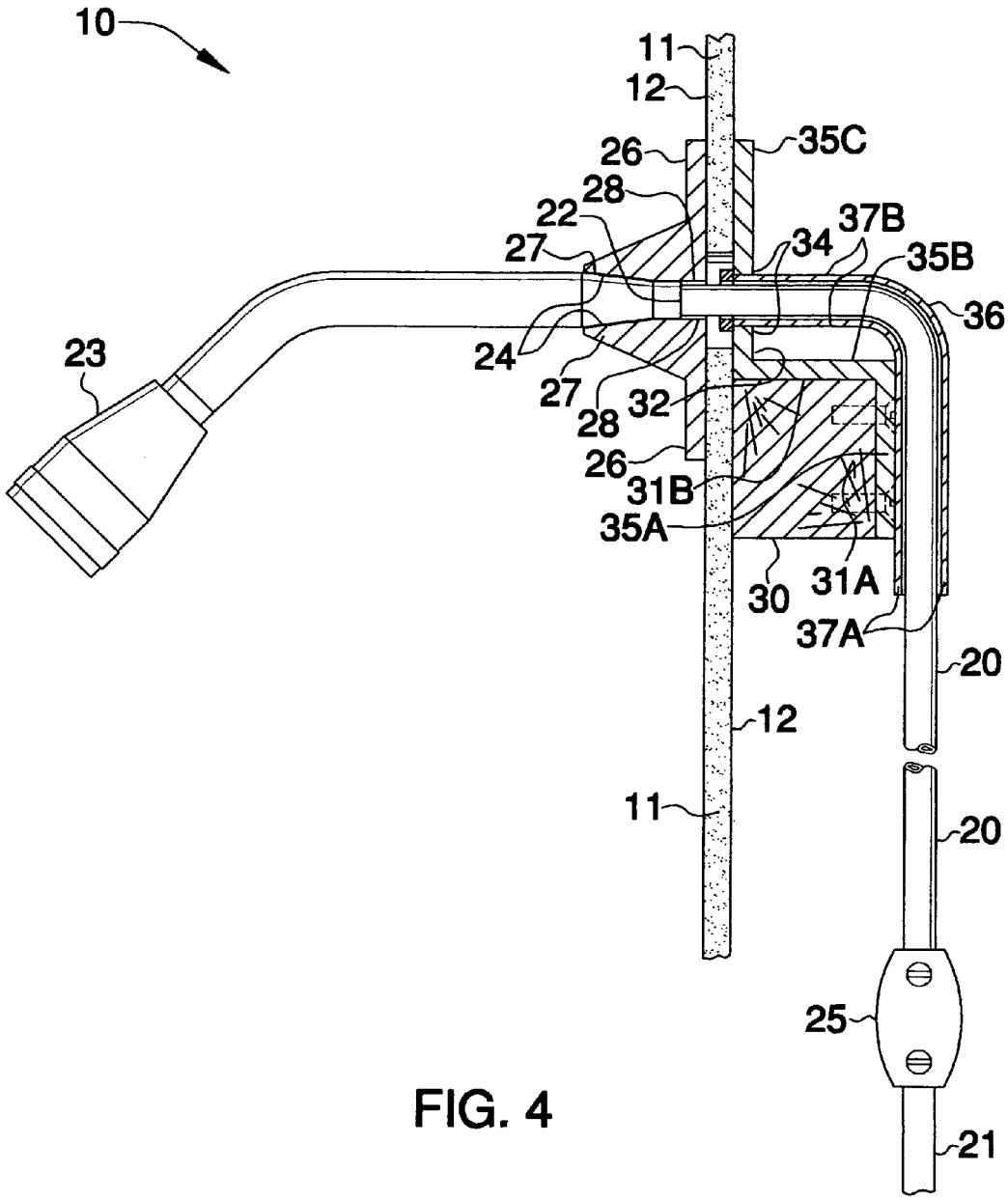
FIG. 4 is a cross-sectional view of the assembly shown in FIG. 3, taken along line 4—4.

Referring to FIGS. 1 through 4, and 6, a wall flange 26 is directly fastened, with no intervening elements, to an exterior surface of the shower wall 11. Such a wall flange 26 has a monolithically formed funnel portion 27 protruding orthogonally and distally from the shower wall 11 wherein the tapered end portion 24 of the shower head 23 is guided through the funnel portion 27, which is crucial and advantageous for assisting an operator to more effectively maintain the shower head 23 at a stable position when same is adapted to the retracted position, as is best illustrated in FIG. 4. This feature effectively prevents the shower head 23 from pivoting along a vertical axis in relation to the shower wall 11, when fully retracted, which would otherwise interfere with normal showering operating conditions, rendering the assembly 10 ineffective.

Figure 5:
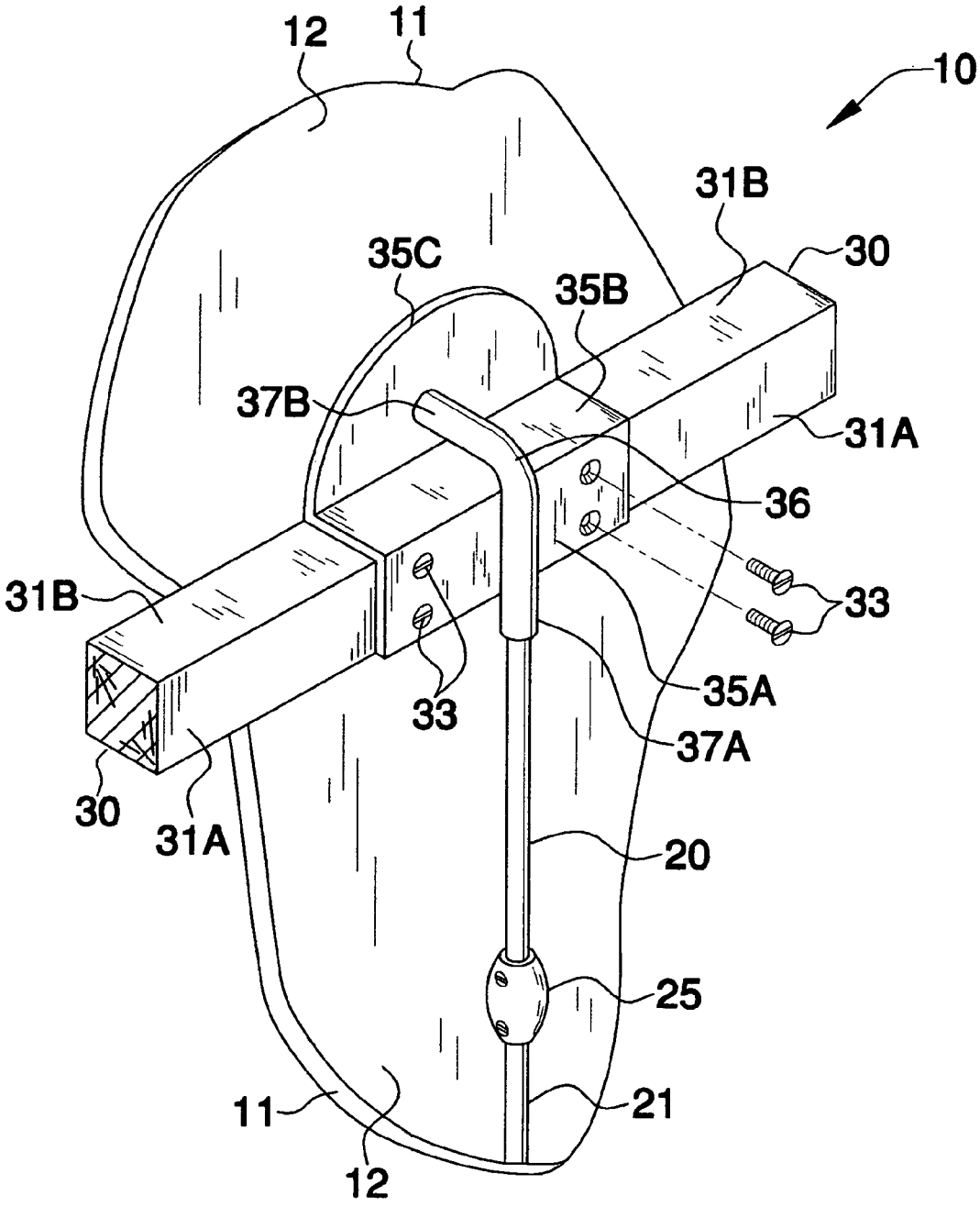
FIG. 5 is a rear perspective view of the assembly shown in FIG. 3, showing the showing the support bracket positioned flush against the support beam and the shower wall.
Figure 6:
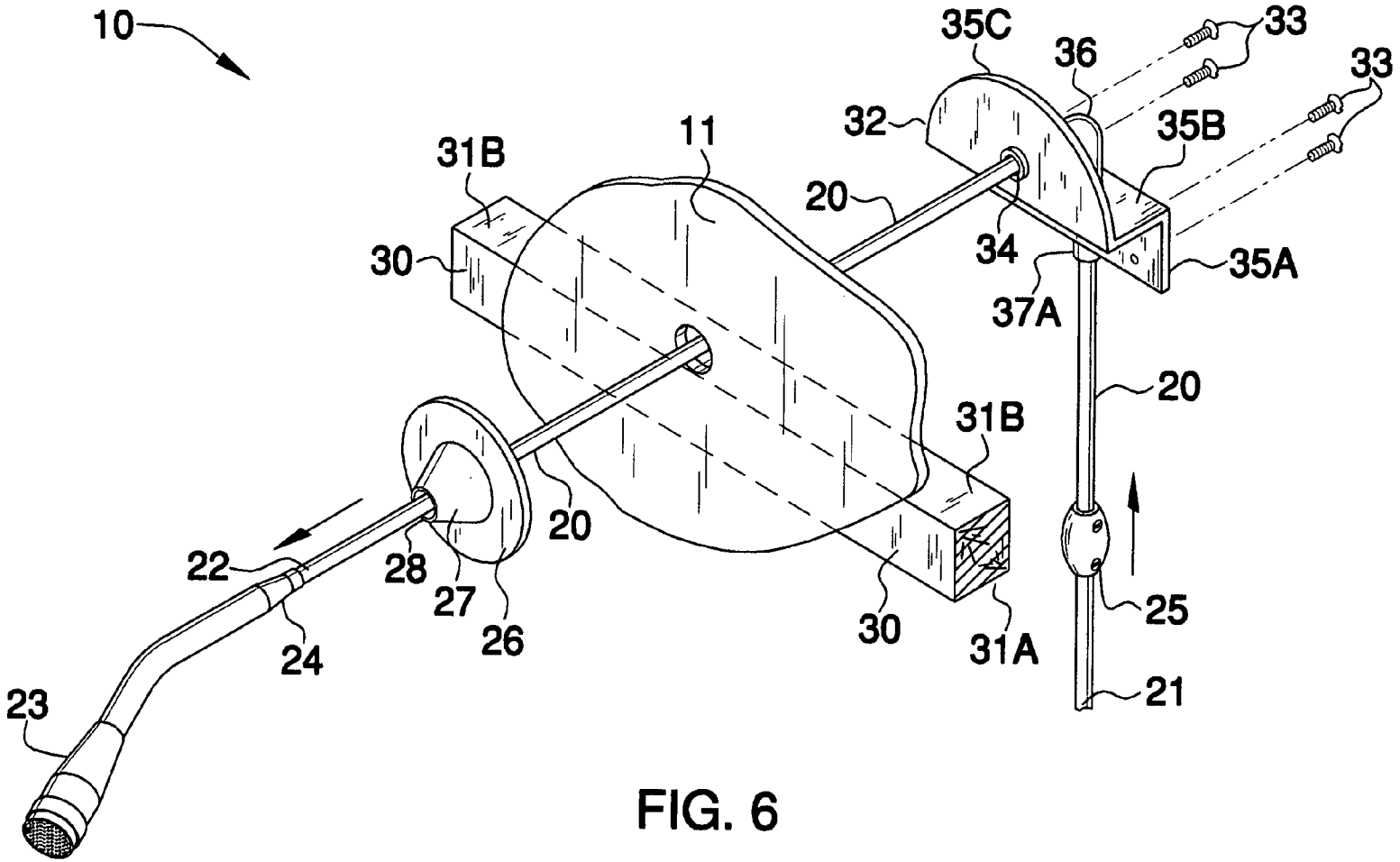
FIG. 6 is a partially exploded perspective view of the assembly shown in FIG. 3.

Referring to FIGS. 3 through 6, an elongated and rigid support beam 30 has a centrally disposed longitudinal axis positioned orthogonal to a longitudinal axis of the shower wall 11 in such a manner that the support beam 30 traverses a travel path of the conduit 20. Such a support beam 30 is directly attached, with no intervening elements, to a rear surface 12 of the shower wall 11 and has a pair of monolithically formed sides 31 disposed orthogonal to each other, as is best shown in FIG. 5.

Still referring to FIGS. 3 through 6, a support bracket 32 is securely and directly fastened, with no intervening elements, to one 31A of the support beam sides 31 by means of a plurality of fastening members 33 such that the support bracket 32 is effectively maintained at a static position and further maintains continuous surface area contact with the support beam sides 31 as well as a selected portion of the shower wall rear surface 12. Such a support bracket 32 has an aperture 34 formed therein that is vital for receiving and guiding the conduit 20 through the shower wall. The wall flange 26 has an aperture 28 horizontally registered with the support bracket aperture 34, which is essential for effectively guiding the conduit 20 along a horizontal path exiting the shower wall 11.

Again referring to FIGS. 3 through 6, the support bracket 32 further includes monolithically formed first 35A, second 35B and third 35C walls. Such first 35A and third 35C walls are registered parallel to each other. The second wall 35B is medially situated between the first 35A and third 35C walls and extends orthogonal thereto respectively. The first 35A, second 35B, and third 35C walls are sized and shaped for conforming to the support beam sides 31, which is critical such that the support bracket 32 can advantageously be effectively leveraged and supported by the support beam 30 during operating conditions. This feature advantageously ensures that the assembly 10 remains stable and secure during operating conditions as the conduit 20 is extended therefrom and returned to a retracted position.

Such a third wall 35C of the support bracket 32 and the wall flange 26 are aligned on opposite faces of the shower wall 11 in such a manner that the shower wall 11 becomes intercalated therebetween. The second wall 35B of the support bracket 32 has a latitudinal length equal to a latitudinal length of one 31B of the support beam sides 31 such that the third wall 35C of the support bracket 32 can effectively be directly engaged and remain flush with the shower wall 11.

Yet again referring to FIGS. 3 through 6, a non-linear sleeve 36 is directly fastened, with no intervening elements, to the support bracket 32 and the support beam 30 wherein the sleeve 36 extends rearwardly from the shower wall 11. Such a sleeve 36 has monolithically formed first 37A and second 37B end portions for directing the conduit 20 along vertical and horizontal paths during operating conditions and thereby advantageously allowing a user to minimize frictional contact with the support bracket 32 and the support beam 30 when extracting the shower head 23 away from the shower wall 11. Advantageously, a reduction in frictional contact of the conduit 20 with the support bracket 32 and the support beam 30 reduces the amount of wear of the conduit 20, which is vital to ensuring the longevity thereof. Thus, a user does not have to be concerned that a leak may form in the conduit 20 that could lead to significant structural damage of the shower walls 11 and surrounding areas, as often occurs in bathroom facilities.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A retractable shower head assembly for assisting a user to more effectively extend and retract the shower head from a rested position, said shower head assembly comprising:

an elongated and flexible conduit having a first end portion operably engageable with a water supply source and in direct fluid communication therewith for channeling water along an upward and unidirectional path through said conduit, said conduit further having a second end portion situated exterior of a vertical shower wall wherein said second end portion can be selectively adapted between extended and retracted positions defined distally from the shower wall;

a shower head having a tapered end portion directly conjoined to said second end portion of said conduit;

a wall flange directly fastened to an exterior surface of the shower wall, said wall flange having a monolithically formed funnel portion protruding orthogonally and distally from the shower wall wherein said tapered end portion of said shower head is guided through said funnel portion for assisting an operator to more effectively maintain said shower head at a stable position when adapted to the retracted position;

an elongated and rigid support beam having a centrally disposed longitudinal axis positioned orthogonal to a longitudinal axis of the shower wall in such a manner that said support beam traversing a travel path of said conduit, said support beam being directly attached to a rear surface of the shower wall and having a pair of monolithically formed sides disposed orthogonal to each other;

a support bracket securely and directly fastened to one said support beam sides such that said support bracket is maintained at a static position and further maintains continuous surface area contact with said support beam sides as well as a selected portion of the shower wall rear surface; and a non-linear sleeve directly fastened to said support bracket and said support beam wherein said sleeve extends rearwardly from the shower wall, said sleeve having monolithically formed first and second end portions for directing said conduit along vertical and horizontal paths during operating conditions and thereby allowing a user to minimize frictional contact with said support bracket and said support beam when extracting said shower head away from the shower wall.

2. The shower head assembly of claim 1, further comprising: a weight member directly conjoinable to a portion of said conduit which remains hidden behind the shower wall, said weight member creating a downward force for counteracting a user's lateral force when extracting said shower head from the rested position and thereby causing said shower head and said conduit to retract back to the rested position when the user decreases the lateral force beyond a minimal threshold.

3. The shower head assembly of claim 2, wherein said weight member is slidably positional along a length of said conduit and securely engageable at alternate positions as desired by the user.

4. The shower head assembly of claim 3, wherein said support bracket comprises:

monolithically formed first, second and third walls, said first and third walls being registered parallel to each other, said second wall being medially situated between said first and third walls and extending orthogonal thereto respectively, said first, second and third walls being sized and shaped for conforming to said support beam sides such that said support bracket can be effectively leveraged and supported by said support beam during operating conditions.

5. The shower assembly of claim 4, wherein said third wall of said support bracket and said wall flange are aligned on opposite faces of the shower wall in such a manner that the shower wall becomes intercalated therebetween.

6. The shower assembly of claim 5, wherein said second wall of said support bracket has a latitudinal length equal to a latitudinal length of one said support beam sides such that said third wall of said support bracket can be directly engaged and remain flush with the shower wall.

7. A retractable shower head assembly for assisting a user to more effectively extend and retract the shower head from a rested position, said shower head assembly comprising:

an elongated and flexible conduit having a first end portion operably engageable with a water supply source and in direct fluid communication therewith for channeling water along an upward and unidirectional path through said conduit, said conduit further having a second end portion situated exterior of a vertical shower wall wherein said second end portion can be selectively adapted between extended and retracted positions defined distally from the shower wall;

a shower head having a tapered end portion directly conjoined to said second end portion of said conduit;

a wall flange directly fastened to an exterior surface of the shower wall, said wall flange having a monolithically formed funnel portion protruding orthogonally and distally from the shower wall wherein said tapered end portion of said shower head is guided through said funnel portion for assisting an operator to more effectively maintain said shower head at a stable position when adapted to the retracted position;

an elongated and rigid support beam having a centrally disposed longitudinal axis positioned orthogonal to a longitudinal axis of the shower wall in such a manner that said support beam traversing a travel path of said conduit, said support beam being directly attached to a rear surface of the shower wall and having a pair of monolithically formed sides disposed orthogonal to each other;

a support bracket securely and directly fastened to one said support beam sides such that said support bracket is maintained at a static position and further maintains continuous surface area contact with said support beam sides as well as a selected portion of the shower wall rear surface, said support bracket has an aperture formed therein for receiving and guiding said conduit through the shower wall; and a non-linear sleeve directly fastened to said support bracket and said support beam wherein said sleeve extends rearwardly from the shower wall, said sleeve having monolithically formed first and second end portions for directing said conduit along vertical and horizontal paths during operating conditions and thereby allowing a user to minimize frictional contact with said support bracket and said support beam when extracting said shower head away from the shower wall.

8. The shower head assembly of claim 7, further comprising: a weight member directly conjoinable to a portion of said conduit which remains hidden behind the shower wall, said weight member creating a downward force for counteracting a user's lateral force when extracting said shower head from the rested position and thereby causing said shower head and said conduit to retract back to the rested position when the user decreases the lateral force beyond a minimal threshold.

9. The shower head assembly of claim 8, wherein said weight member is slidably positional along a length of said conduit and securely engageable at alternate positions as desired by the user.

10. The shower head assembly of claim 9, wherein said support bracket comprises:

monolithically formed first, second and third walls, said first and third walls being registered parallel to each other, said second wall being medially situated between said first and third walls and extending orthogonal thereto respectively, said first, second and third walls being sized and shaped for conforming to said support beam sides such that said support bracket can be effectively leveraged and supported by said support beam during operating conditions.

11. The shower assembly of claim 10, wherein said third wall of said support bracket and said wall flange are aligned on opposite faces of the shower wall in such a manner that the shower wall becomes intercalated therebetween.

12. The shower assembly of claim 11, wherein said second wall of said support bracket has a latitudinal length equal to a latitudinal length of one said support beam sides such that said third wall of said support bracket can be directly engaged and remain flush with the shower wall.

13. A retractable shower head assembly for assisting a user to more effectively extend and retract the shower head from a rested position, said shower head assembly comprising:

an elongated and flexible conduit having a first end portion operably engageable with a water supply source and in direct fluid communication therewith for channeling water along an upward and unidirectional path through said conduit, said conduit further having a second end portion situated exterior of a vertical shower wall wherein said second end portion can be selectively adapted between extended and retracted positions defined distally from the shower wall;

a shower head having a tapered end portion directly conjoined to said second end portion of said conduit;

a wall flange directly fastened to an exterior surface of the shower wall, said wall flange having a monolithically formed funnel portion protruding orthogonally and distally from the shower wall wherein said tapered end portion of said shower head is guided through said funnel portion for assisting an operator to more effectively maintain said shower head at a stable position when adapted to the retracted position;

an elongated and rigid support beam having a centrally disposed longitudinal axis positioned orthogonal to a longitudinal axis of the shower wall in such a manner that said support beam traversing a travel path of said conduit, said support beam being directly attached to a rear surface of the shower wall and having a pair of monolithically formed sides disposed orthogonal to each other;

a support bracket securely and directly fastened to one said support beam sides such that said support bracket is maintained at a static position and further maintains continuous surface area contact with said support beam sides as well as a selected portion of the shower wall rear surface, said support bracket has an aperture formed therein for receiving and guiding said conduit through the shower wall, said wall flange has an aperture horizontally registered with the support bracket aperture for guiding said conduit along a horizontal path exiting the shower wall; and a non-linear sleeve directly fastened to said support bracket and said support beam wherein said sleeve extends rearwardly from the shower wall, said sleeve having monolithically formed first and second end portions for directing said conduit along vertical and horizontal paths during operating conditions and thereby allowing a user to minimize frictional contact with said support bracket and said support beam when extracting said shower head away from the shower wall.

14. The shower head assembly of claim 13, further comprising: a weight member directly conjoinable to a portion of said conduit which remains hidden behind the shower wall, said weight member creating a downward force for counteracting a user's lateral force when extracting said shower head from the rested position and thereby causing said shower head and said conduit to retract back to the rested position when the user decreases the lateral force beyond a minimal threshold.

15. The shower head assembly of claim 14, wherein said weight member is slidably positional along a length of said conduit and securely engageable at alternate positions as desired by the user.

16. The shower head assembly of claim 15, wherein said support bracket comprises:

monolithically formed first, second and third walls, said first and third walls being registered parallel to each other, said second wall being medially situated between said first and third walls and extending orthogonal thereto respectively, said first, second and third walls being sized and shaped for conforming to said support beam sides such that said support bracket can be effectively leveraged and supported by said support beam during operating conditions.

17. The shower assembly of claim 16, wherein said third wall of said support bracket and said wall flange are aligned on opposite faces of the shower wall in such a manner that the shower wall becomes intercalated therebetween.

18. The shower assembly of claim 17, wherein said second wall of said support bracket has a latitudinal length equal to a latitudinal length of one said support beam sides such that said third wall of said support bracket can be directly engaged and remain flush with the shower wall.

* * * * *